US007309278B2

(12) United States Patent
Shibata

(10) Patent No.: US 7,309,278 B2
(45) Date of Patent: Dec. 18, 2007

(54) LEAN PRESSER FOR HOLDING EYEGLASS LENS AND EYEGLASS LENS PROCESSING APPARATUS HAVING THE SAME

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/412,875

(22) Filed: Apr. 28, 2006

(65) Prior Publication Data

US 2006/0262661 A1 Nov. 23, 2006

(30) Foreign Application Priority Data

Apr. 28, 2005 (JP) ..... P2005-133736

(51) Int. Cl.
*B24B 41/06* (2006.01)

(52) U.S. Cl. ..... 451/384; 451/387; 451/405

(58) Field of Classification Search ..... 451/42, 451/384, 385, 390, 367, 387, 398, 405
See application file for complete search history.

(56) References Cited

U.S. PATENT DOCUMENTS 3,886,696 A * 6/1975 Bruck ..... 451/390
4,535,575 A * 8/1985 Sorrells ..... 451/384
5,357,716 A * 10/1994 Kishida et al. ..... 451/390
6,641,466 B2 * 11/2003 Wallendorf et al. ..... 451/285
6,984,161 B2 1/2006 Suzuki et al.
2004/0058624 A1 3/2004 Suzuki et al.
2005/0250430 A1 * 11/2005 Volken et al. ..... 451/390

FOREIGN PATENT DOCUMENTS

EP 1 243 381 A2 9/2002
JP 2002-370146 A 12/2002
JP 2004-106147 A 4/2004

* cited by examiner

*Primary Examiner*—Eileen P. Morgan
(74) *Attorney, Agent, or Firm*—Sughrue Mion Pllc.

(57) ABSTRACT

A lens presser for holding an eyeglass lens includes: a base member which is to be attached to a distal end of a lens chucking shaft; an abutting member which has an abutting surface which is to be abutted on a rear refractive surface of the lens; a movable member to which the abutting member is to be attached; a circular-arc-shaped concave portion which is formed in one of the base member and the movable member and has a radius center of a circular arc on a central axis of the chucking shaft; and a circular-arc-shaped convex portion which is formed in the other of the base member and the movable member and is fitted into the concave portion so as to slide only in a direction of the circular arc. The movable member is tiltable with respect to the base member.

7 Claims, 6 Drawing Sheets

LEAN PRESSER FOR HOLDING EYEGLASS LENS AND EYEGLASS LENS PROCESSING APPARATUS HAVING THE SAME

BACKGROUND OF THE INVENTION

The present invention relates to a lens presser for holding an eyeglass lens, which is used when the eyeglass lens is processed, and an eyeglass lens processing apparatus having the same.

In an eyeglass lens processing apparatus, an eyeglass lens is rotated while being held (chucked) by two lens chucking shafts, and a periphery of the lens is processed by a processing tool such as a grindstone so as to substantially coincide with a desired target lens shape. As a method of holding (chucking) a lens, there are two kinds of methods, optical-center chucking in which the lens is be held so as to conform (align) an optical center of the lens to a holding (rotation) axis of the lens, and boxing center chucking in which the lens is held so as to conform (align) a geometric center (boxing center) of the target lens shape, which is laid out in the lens, to the holding axis of the lens.

In the boxing center chucking, since a lens is held in a position deviated from the optical center, such a lens presser is proposed that can correspond to a curved surface of the rear refractive surface of a lens (refer to JP-A No. 2002-310146). The above lens presser is provided with a movable member to which an abutting member is attached. The movable member is tiltable (rotatable), centered on a position of a base member attached to a lens chucking shaft.

As shown in FIG. 10, another lens presser is proposed in which a bowl-shaped movable member 903 having an abutting portion 901 is attached to a curved surface of a base member 905 attached to a lens chucking shaft 900R through a screw 907.

In the former lens presser, however, the movable member does not move smoothly and a lens cannot be stably held, because the tilt (rotation) center of the movable member is present in the base member side. On the other hand, in the latter lens presser, the movable member is easily rotated with respect to the lens chucking shaft centered on the holding axis of a lens, and thus the lens cannot be stably held.

In processing a lens, processing water is used for cooling the processed portion of the lens and washing off ground waste of the lens. However, if minute chaff enters between the base member and the movable member of the lens presser, the movable member does not move smoothly. In this case, the base member and the movable member are separated so as to be cleaned, but it is not easy to separate them in the related lens presser.

SUMMARY OF THE INVENTION

Accordingly, it is an object of the present invention to provide a lens presser, which can stably hold a lens and in which a base member and a movable member can be easily separated, and an eyeglass lens processing apparatus having the same.

In order to solve the above object, the present invention is characterized by having the following arrangement.

(1) A lens presser for holding an eyeglass lens comprising:

a base member which is to be attached to a distal end of a lens chucking shaft;

an abutting member which has an abutting surface which is to be abutted on a rear refractive surface of the lens;

a movable member to which the abutting member is to be attached;

a circular-arc-shaped concave portion which is formed in one of the base member and the movable member and has a radius center of a circular arc on a central axis of the chucking shaft; and a circular-arc-shaped convex portion which is formed in the other of the base member and the movable member and is fitted into the concave portion so as to slide only in a direction of the circular arc, wherein the movable member is tiltable with respect to the base member.

(2) The lens presser according to (1), wherein the concave portion has the radius center of the circular arc in the vicinity of the abutting surface of the abutting member in a state where the base member, the movable member, and the abutting member are assembled.

(3) The lens presser according to (1), wherein the convex portion is fitted into the concave portion with a dovetail joint.

(4) The lens presser according to (1), further comprising a detachable restriction member which prevents the convex portion fitted into the concave portion from coming off.

(5) The lens presser according to (4), wherein the abutting member also serves as the restriction member.

(6) The lens presser according to (1), wherein the abutting surface of the abutting member is substantially elliptical.

(7) An eyeglass lens processing apparatus comprising a chucking shaft to which the lens presser according to (1) is attached.

DESCRIPTION OF THE PREFERRED EMBODIMENTS

Figure 1:
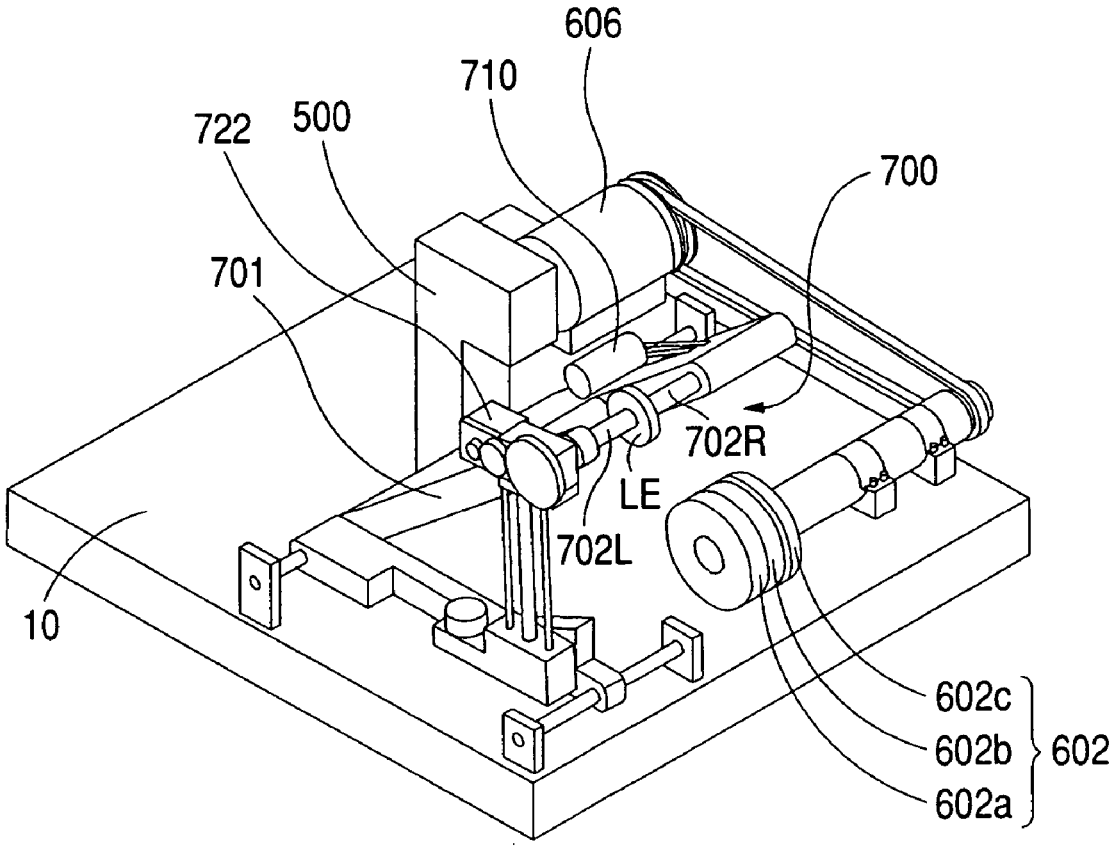
FIG. 1 is a view showing a schematic configuration of a lens processing portion of an eyeglass lens processing apparatus according to an embodiment of the present invention.
Figure 2:
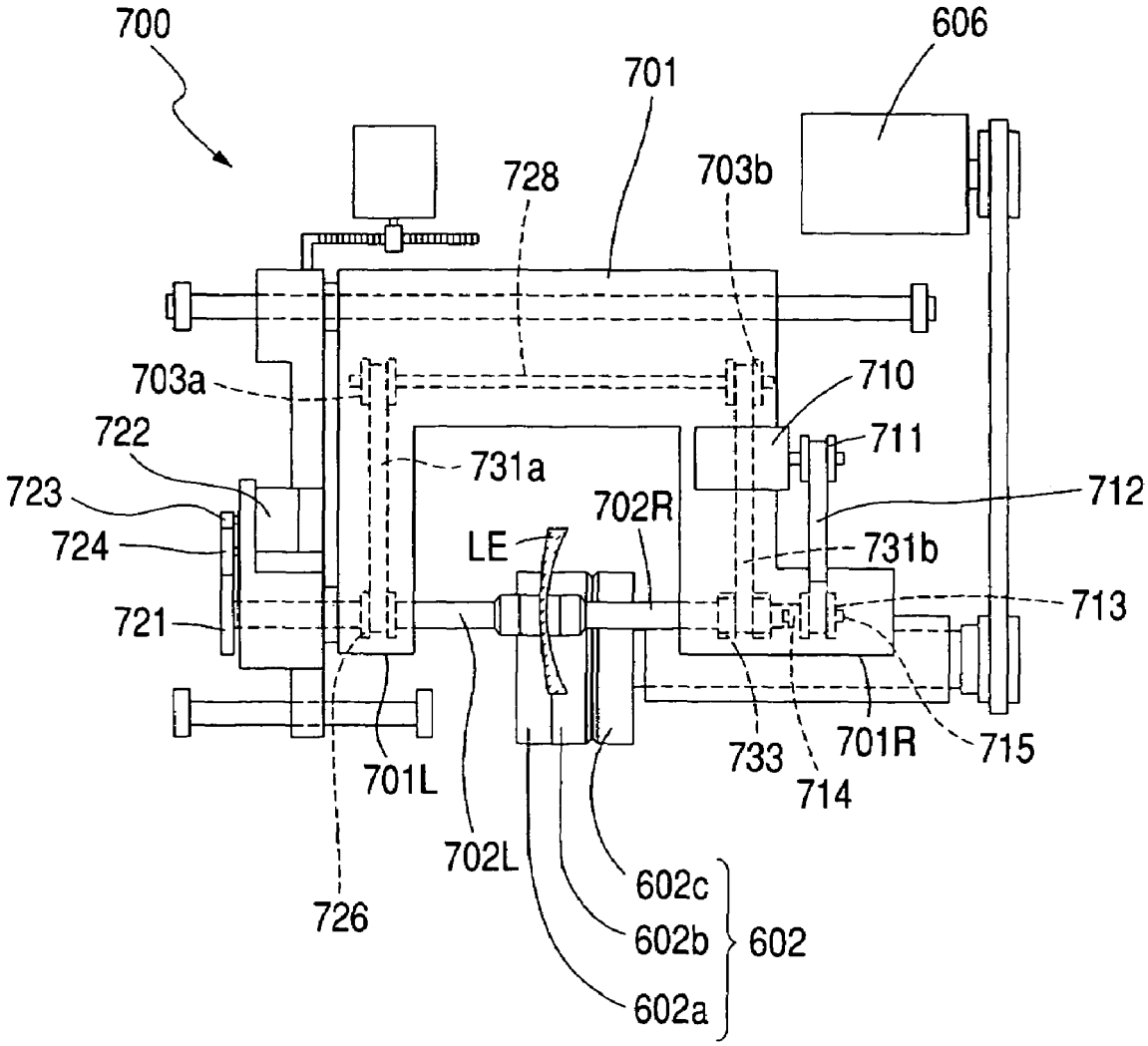
FIG. 2 is a view showing a schematic configuration of a carriage portion of the lens processing portion.

Hereinafter, embodiments according to the present invention will be described with reference to the drawings. FIG. 1 is a view showing a schematic configuration of a lens processing portion of an eyeglass lens processing apparatus according to an embodiment of the present invention. FIG. 2 is a view showing a schematic configuration of a carriage portion 700 of the lens processing portion. The carriage portion 700 including a carriage 700 and its moving mechanism is mounted on a base 10. A lens LE to be processed is held (chucked) and rotated by lens chucking shafts 702L and 702R, which are rotatably held by the carriage 701, and is ground by a grindstone 602. The grindstone 602 of the present embodiment includes a roughing grindstone 602*a* for plastic, a roughing grindstone 602*b* for glass, and a bevel-finishing and plane-finishing grindstone 602*c*. The grindstone 602 is rotated by a grindstone rotating motor 606. A lens shape measuring portion 500 is provided at the back side (inner side) of the carriage portion 700.

The chucking shafts 701L and 701R are held by the carriage 701 so that the central axis thereof is parallel to the central axis of rotation of the grindstone 602. The carriage 701 is movable in a direction of the rotation central axis of the grindstone 602 (that is, a direction of the central axis of the chucking shafts 702L and 702R) (X-axis direction). Further, the carriage 701 is movable in a direction orthogonal to the X-axis direction (that is, a direction in which a distance between the central axis of the chucking shafts 702L and 702R and the rotation central axis of the grindstone 602 changes) (Y-axis direction).

Figure 3:
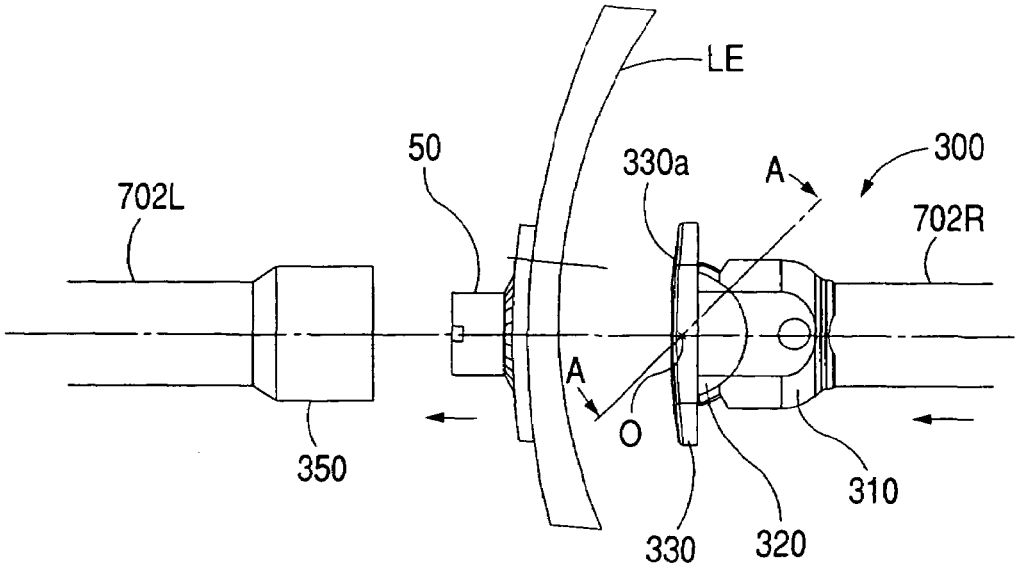
FIG. 3 is a view showing that a lens is held (chucked) by lens chucking shafts.

The chucking shafts 702L and 702R are rotatably and coaxially held by left and right arms 701L and 701R, respectively, of the carriage 701. A cup receiver 350 is attached to a distal end of the chucking shaft 702L, and a lens presser 300 is attached to a distal end of the chucking shaft 702R (refer to FIG. 3). A lens chucking motor 710 is fixed to the right arm 701R. The rotation of the motor 710 is transmitted to a feed screw 715 via a pulley 711 attached to the rotating shaft of the motor 701, a belt 712 and a pulley 713 attached to the feed screw 715. Then, a feed nut 714 screwed to the feed screw 715 is moved in its axial direction, and the chucking shaft 702R coupled with the nut 714 is moved in its axial direction. When the lens LE is processed, as shown in FIG. 3, a cup 50 that is a fixture is attached to the front refractive surface of the lens LE. A base of the cup 50 is mounted to the cup receiver 350 attached to the chucking shaft 702L. Further, by driving the motor 710, the chucking shaft 702R is moved in a direction in which it approaches the chucking shaft 702L, the lens presser 300 attached to the chucking shaft 702R abuts on the rear refractive surface of the lens LE, and the lens LE is held (chucked) by the chucking shafts 702L and 702R.

A lens rotating motor 722 is fixed to the left arm 701L. The rotation of the motor 722 is transmitted to the chucking shaft 702L via a gear 723 attached to the rotating shaft of the motor 722, a gear 724 and a gear 721 attached to the chucking shaft 702L. Further, the rotation of the motor 722 is transmitted to the chucking shaft 702R via a pulley 726 attached to the chucking shaft 702L, a belt 731*a*, a pulley 703*a*, a rotating shaft 728, a pulley 703*b*, a belt 731*b*, and a pulley 733 attached to the chucking shaft 702R. Accordingly, the chucking shafts 702L and 702R are rotated synchronously, and the held (chucked) lens LE is rotated.

Figure 4A:
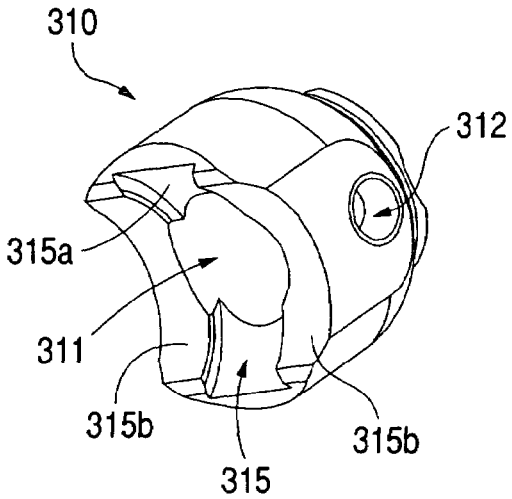
FIG. 4A is a perspective view of a base member.
Figure 4B:
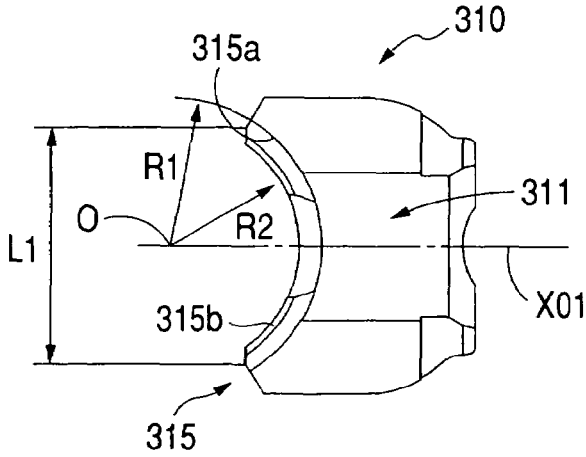
FIG. 4B is a side sectional view of the base member.
Figure 5A:
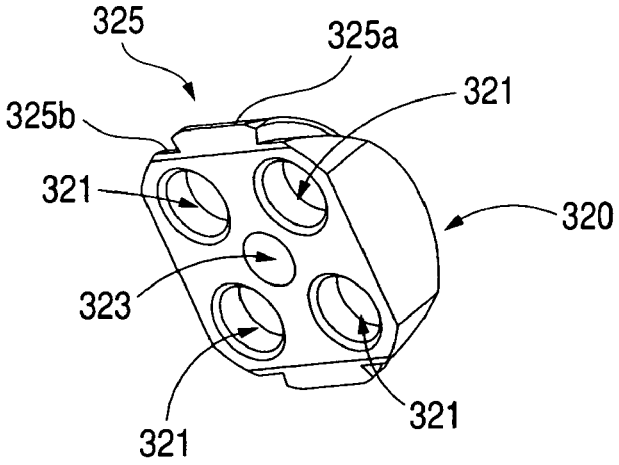
FIG. 5A is a perspective view of a movable member.
Figure 5B:
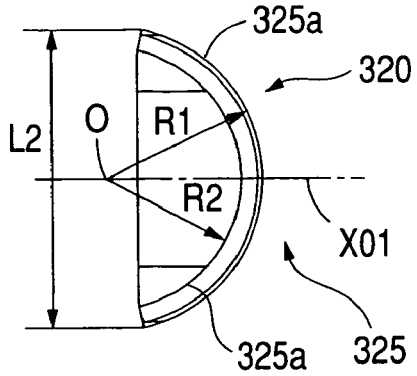
FIG. 5B is a lateral view of the movable member.
Figure 6A:
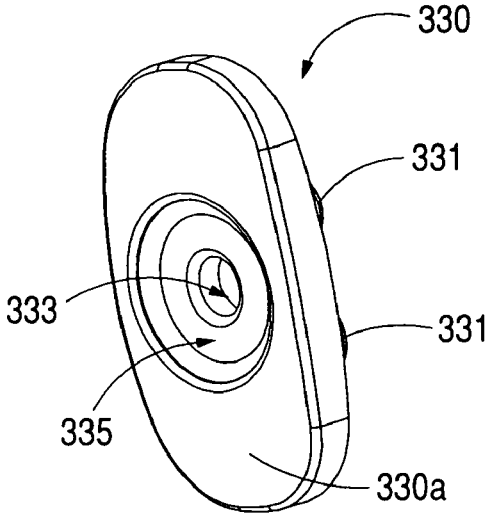
FIG. 6A is a perspective view of an abutting member.
Figure 6B:
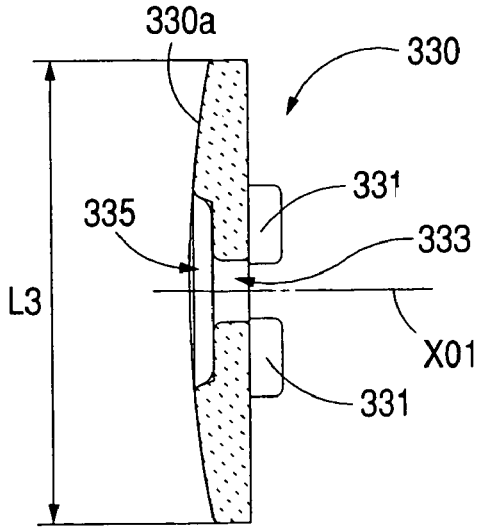
FIG. 6B is a side sectional view of the abutting member.
Figure 7:
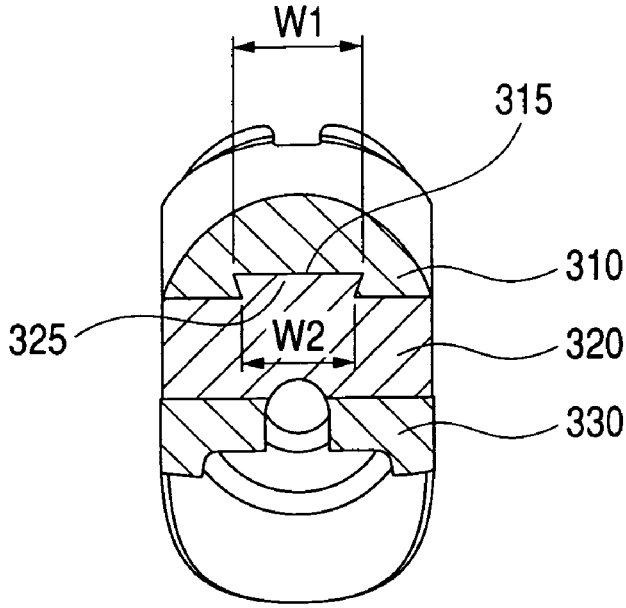
FIG. 7 is a sectional view taken along the line A-A of FIG. 3.

Next, the lens presser 300 will be described with reference to FIGS. 3 to 7. The lens presser 300 includes a base member 310 which is to be attached and fixed to the distal end of the chucking shaft 702R, a movable member 320 which is to be tilt-adjustably (rotatably) attached to the base member 310, and an abutting member 330 which is to be attached to the movable member 302 and has an abutting surface 303*a* which is to be abutted on the rear refractive surface of the lens LE. FIG. 4A is a perspective view of the base member 310, and FIG. 4B is a side sectional view of the base member 310. FIG. 5A is a perspective view of the movable member 320, and FIG. 5B is a lateral view of the movable member 320. FIG. 6A is a perspective view of the abutting member 330, and FIG. 6B is a side sectional view of the abutting member 330. FIG. 7 is a sectional view taken along the line A-A of FIG. 3.

The base member 310 is formed of metal such as stainless steel. A hole 311 into which the distal end of the chucking shaft 702R is to be inserted is formed inside the base member 310. Further, a screw hole 312 into which a screw for attaching and fixing the base member 310 to the chucking shaft 702R is to be inserted is formed on the side surface of the base member 310. A dovetail groove 315 as a circular-arc-shaped concave portion is formed on the side where the base member 310 is to be attached to the movable member 320. The cross-section of the dovetail groove 315, orthogonal to the longitudinal direction thereof, is dovetail-shaped, and the width W1 of the cross-section is smaller than the width W2 thereof (refer to FIG. 7). Further, a groove surface (inner surface) 315*a* of the dovetail groove 315 is formed in a circular-arc shape whose radius R1 is 10 mm and whose center is set to the center O on the central axis X01 of the chucking shaft 702R, and both outer surfaces 315*b* of the dovetail groove 315 are formed in a circular-arc shape whose radius R2 is 8.5 mm and whose the center is set to the center O. The center O is almost the same position as the abutting surface 330*a* of the abutting member 330 when the lens presser 300 (base member 310, the movable member, and the abutting member 330) is assembled (refer to FIG. 3). Further, the groove surface 315*a* of the dovetail groove 315 has a length L1 of 16 mm in a direction orthogonal to the central axis X01.

The movable member 320 is formed of resin having a metallic characteristic and softness, such as Delrin made by du Pond Corporation. In the base member 310 side of the movable member 320, a dovetail 325 as a circular-arc-shaped convex portion is formed, which is to be slidably fitted only in a circular arc direction of the dovetail groove 315. Similar to the cross-section of the dovetail groove 315, the cross-section of the dovetail 325, orthogonal to the longitudinal direction thereof, is dovetail-shaped, and the width W1 of the cross-section is smaller than the width W2 thereof (refer to FIG. 7). The top surface 325*a* of the dovetail 325 is formed in a circular arc shape whose radius r1 is 9.9 mm and whose the center is set to the center O, and both outer surfaces 323*b* of the dovetail 325 are formed in a circular arc shape whose radius r2 is 8.5 mm and whose the center is set to the center O. The top surface 325*a* of the dovetail 325 has a length L2 of 19 mm in a direction orthogonal to the central axis X01. Four holes 321 are formed in the side where the movable member 320 is to be attached to the abutting member 330. Further, a through-hole 323 is formed in the center of the movable member 320.

The abutting member 330 is formed of elastic resin such as rubber. The abutting member 330 also serves as a restriction member which prevents the movable member 320 from coming off from the base member 310 (detailed descriptions will be made below). Four projections 331 which are to be respectively fitted into the holes 321 of the movable member 320 are formed in the movable member 320 side of the abutting member 330. The shape of the abutting member 330 in a direction orthogonal to the central axis X01 is substantially elliptical, and the abutting member 330 is to be attached to the movable member 320 so that the longitudinal direction of the elliptic shape coincides with a circular-arc direction of the dovetail 325 of the movable member 320. The longitudinal length L3 of the substantially elliptical abutting member 330 in a direction orthogonal to the central axis X01 is 30 mm, and the short-side length of the substantially elliptical abutting member 330 in a direction orthogonal to the central axis X01 is 17 mm. The substantially elliptic shape of the abutting surface 330*a* of the abutting member 330 is almost the same as the substantial elliptic shape of the cup 50.

A through-hole 333 is formed in the center of the abutting member 330. Further, a hole 335 with a step, of which the diameter is larger than the through-hole 333, is formed in the center of the abutting surface 330*a* of the abutting member 330. The holes 335 and 333 are set to a discharge port of air when the rear refractive surface of the lens LE abuts on the abutting surface 330*a*, and the air is discharged outside through the hole 323 of the movable member 320 and the hole 311 of the base member 310.

The lens presser 300 having such a construction is assembled as follows. First, the dovetail 325 of the movable member 320 is inserted and fitted into the dovetail groove 315 of the base member 310 so that the movable member 320 is attached to the base member 310. Next, the projections 331 of the abutting member 330 are inserted and fitted into the holes 331 of the movable member 320 so that the abutting member 330 is attached to the movable member 320. Since the longitudinal length L3 of the abutting member 330 is larger than the length L1 of the dovetail groove 315 and the length L2 of the dovetail 325, the movable member 320 does not come off from the base member 310 even though being tilted along the dovetail groove 315. That is, the abutting member 330 functions as a restriction member which prevents the movable member 320 (dovetail 325) from coming off from the base member 310 (dovetail groove 315) in the circular arc direction. Moreover, the restriction member may be provided for exclusive use. For example, after the movable member 320 is attached to the base member 310, the restriction member may be attached to either side of the dovetail 325 (if the movable member 320 is prevented from coming off in one end of the dovetail groove 315, the restriction member is attached only on the end of the dovetail 325 in the other end side). Further, when the dovetail groove 315 is larger than the dovetail 325, the restriction member may be attached to the dovetail groove 315.

The abutting member 330 is set to be tiltable (rotatable) at about ±30° with respect to the base member 310 via the movable member 320.

Figure 8:
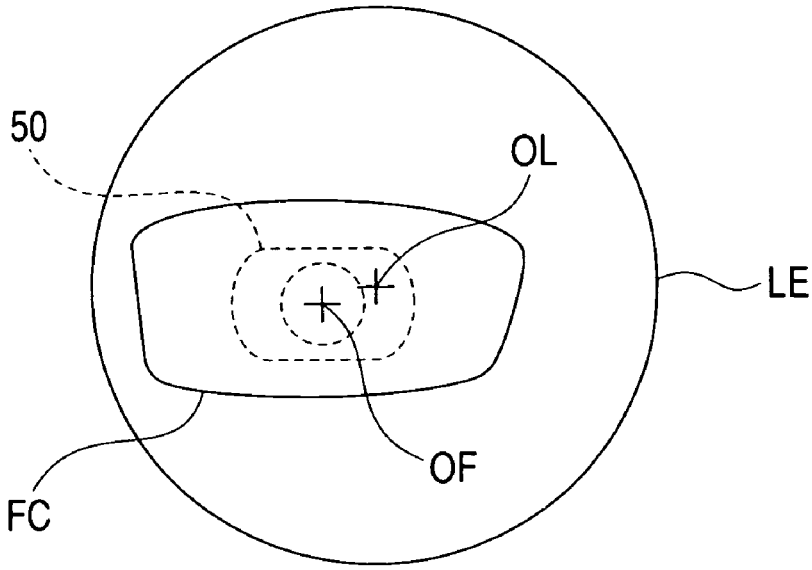
FIG. 8 is a view showing an example of the layout of a target lens shape with respect to an unprocessed lens.

Holding of the lens LE by the lens presser 300 will be described. FIG. 8 is a view showing an example of the layout of a target lens shape with respect to an unprocessed lens LE. OL represents the optical center of the lens LE, and OF represents the geometric center (boxing center) of the target lens shape FC. As a method in which the cup 50 is attached and fixed to the lens LE, there are two kinds of methods, optical center blocking in which the optical center OL is conformed (aligned) to the axis of the cup 50, and boxing center blocking in which the geometric center OF is conformed (aligned) to the axis of the cup 50. The cup 50 which has been optical-center-blocked is mounted on the cup receiver 350, so that the lens LE is chucked at the optical center by the chucking shafts 702L and 702R (optical center chucking). The cup 50 which has been boxing center-blocked is mounted on the cup receiver 350, so that the lens LE is chucked at the boxing center by the chucking shafts 702L and 702R (boxing center chucking). The boxing center blocking is used when the width of the target lens shape FC in the up and down direction is narrow or when the deviation of the boxing center OF with respect to the optical center OL is large. The cup 50 is attached and fixed to the lens LE by a well-known blocking apparatus. The left and right direction of FIG. 8 is a direction of the distance between the pupils of a wearer (a person who uses a pair of eyeglasses). The deviation of the boxing center OL with respect to the optical center OF is typically larger in the left and right direction than in the up and down direction.

When the cup 50 is boxing-center-blocked to the lens LE in which the target lens shape FC is laid out, the cup 50 is attached and fixed so that the longitudinal direction of the substantially-elliptical cup 50 coincides with the longitudinal direction (left and right direction) of the target lens shape FC. When the lens LE to which the cup 50 is fixed is held (chucked) by the chucking shafts 702L and 702R, the cup 50 is mounted an the cup receiver 350 so that the longitudinal direction of the cup 50 coincides with the longitudinal direction of the abutting member 330 (abutting surface 330*a*). Further, as the chucking shaft 702R is moved in a direction in which it approaches the chucking shaft 702L, the lens LE is held (chucked). In the lens presser 300, since the abutting member 330 is tiltable in the longitudinal direction via the movable member 320, the abutting member 330 is tilted and abutted so as to correspond to a curved surface corresponding to the longitudinal direction of the target lens shape FC of the rear refractive surface of the lens LE.

Since the dovetail 325 is guided by the dovetail groove 315 so as to slide, the movement of the movable member 320 becomes smooth. Further, as the movable member 320 is tiltable with respect to the base member 310 and can be deformed by a chucking pressure due to the movement of the chucking shaft 702R, the lens LE is can be stably held. Since the tilt width of the abutting member 330 is broadened, the abutting area onto the lens LE can be widely secured, and even a lens subjected to super-hydrophobic coating can be stably held.

Based on the target lens shape, the periphery of the lens LE is ground by the grindstone 602. Moreover, the apparatus of the present embodiment is such an apparatus which processes a lens by moving the lens with respect to a grindstone. However, the apparatus may be such an apparatus which processes a lens by moving one grindstone or a plurality of grindstones.

When the movement of the movable member 320 with respect to the base member 310 is not smooth due to grinding waste (chaff) generated by processing the lens LE, the movable member 320 is removed from the base member 310 and is cleaned. That is, first, the projections 331 of the abutting member 330 are pulled off from the holes 321 of the movable member 320 so that the abutting member 330 is removed from the movable member 320. Next, the dovetail 325 of the movable member 320 is taken out of the dovetail groove 315 of the base member 310 so that the movable member 320 is removed from the base member 310.

Figure 9:
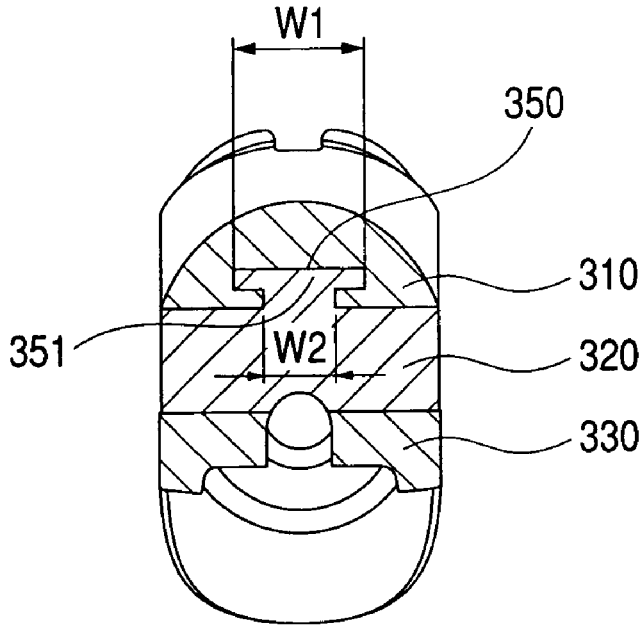
FIG. 9 is a view showing a modified example of a concave portion of the base member and a convex portion of the movable member.
Figure 10:
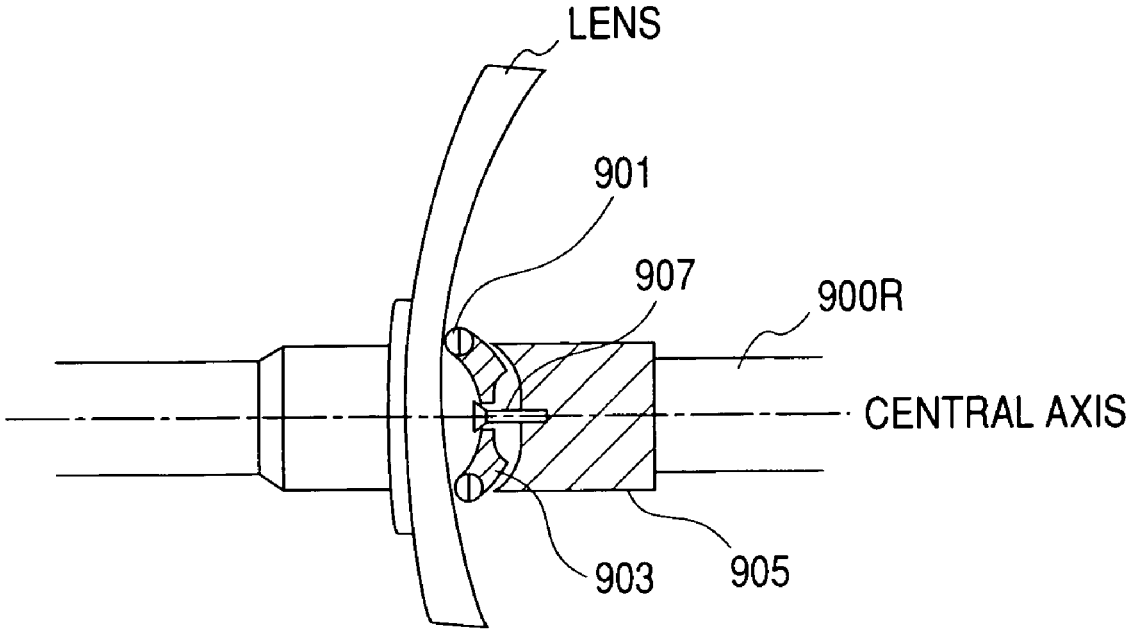
FIG. 10 is a view showing an example of a lens presser in the related art.

In the above-described embodiment, various modifications can be made. For example, although the concave portion (dovetail groove) is formed in the base member 310 and the convex portion (dovetail) is formed in the movable member 320 in the above description, the concave portion may be formed in the movable member 320 and the convex portion may be formed in the base member 310. Further, the respective cross-sections of the circular-arc-shaped concave portion and the circular-arc-shaped convex portion may be formed in a substantial T shape, as shown in FIG. 9. Further, the width W1 of the respective cross-sections of the concave portion 350 and the convex portion 351 becomes smaller than the width W2, and the convex portion 351 is to be fitted into the concave portion 350 so as to slide only in the circular arc direction.

What is claimed is:

1. A lens presser comprising:

a base member which is to be attached to a distal end of a lens chucking shaft;

an abutting member which has an abutting surface which is to be abutted on a rear refractive surface of the lens;

a movable member to which the abutting member is to be attached;

a circular-arc-shaped concave portion which is formed in one of the base member and the movable member and has a radius center of a circular arc on a central axis of the chucking shaft; and a circular-arc-shaped convex portion which is formed in the other of the base member and the movable member and has a radius center of a circular arc on a central axis of the chucking shaft in the state where the base member, the movable member and the abutting member are assembled to the chucking shaft, wherein the convex portion is fitted into the concave portion so as to slide in a direction of the circular arc, and the movable member is tiltable with respect to the base member wherein the concave portion and the convex portion have the radius centers of the circular arcs, which correspond to a tilting center of the movable member, in the vicinity of the abutting surface of the abutting member in a state where the base member, the movable member, and the abutting member are assembled to the chucking shaft, respectively.

2. The lens presser according to claim 1, wherein the concave portion is a dovetail groove, the convex portion is a dovetail and the convex portion is fitted into the concave portion with a dovetail joint.

3. The lens presser according to claim 1, further comprising a detachable restriction member which prevents the convex portion fitted into the concave portion from coming off.

4. The lens presser according to claim 3, wherein the abutting member also serves as the restriction member.

5. The lens presser according to claim 1, wherein the abutting surface of the abutting member is substantially elliptical.

6. An eyeglass lens processing apparatus comprising a lens chucking shaft to which the lens presser according to claim 1 is attached.

7. A lens presser comprising:

a base member which is to be attached to a distal end of a lens chucking shaft;

an abutting member which has an abutting surface which is to be abutted on a rear refractive surface of the lens;

a movable member to which the abutting member is to be attached;

a circular-arc-shaped concave portion which is formed in one of the base member and the movable member and has a radius center of a circular arc on a central axis of the chucking shaft; and a circular-arc-shaped convex portion which is formed in the other of the base member and the movable member and has a radius center of a circular arc on a central axis of the chucking shaft in the state where the base member, the movable member and the abutting member are assembled to the chucking shaft, wherein the convex portion is fitted into the concave portion so as to slide in a direction of the circular arc, and the movable member is tiltable with respect to the base member, and wherein the abutting member in the assembled state prevents the convex portion fitted into the concave portion from coming off.

* * * * *